US007219815B2

(12) United States Patent
Shannon et al.

(10) Patent No.: US 7,219,815 B2
(45) Date of Patent: May 22, 2007

(54) DISPENSER FOR DISPENSING TWO DIFFERENT SUBSTRATES

(75) Inventors: Thomas Gerard Shannon, Neenah, WI (US); Scott Allen Baum, Hortonville, WI (US); Duane Lyle McDonald, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 328 days.

(21) Appl. No.: 10/748,034

(22) Filed: Dec. 30, 2003

(65) Prior Publication Data

US 2005/0178788 A1 Aug. 18, 2005

(51) Int. Cl.
*A47F 1/04* (2006.01)

(52) U.S. Cl. ..... 221/305; 221/283; 221/65; 221/33

(58) Field of Classification Search ..... 221/199; 220/737

See application file for complete search history.

(56) References Cited

U.S. PATENT DOCUMENTS

| | | | | |
|---|---|---|---|---|
| 2,611,482 | A | 9/1952 | Howard | |
| 2,864,495 | A | 12/1958 | Ritchie | |
| 2,921,676 | A | 1/1960 | Carignan | |
| 3,214,059 | A | 10/1965 | Stark | |
| 3,258,238 | A | 6/1966 | Grafton | |
| 3,285,398 | A | 11/1966 | Daniel | |
| 3,414,157 | A | 12/1968 | Wright | |
| 3,630,343 | A | 12/1971 | Wohl | |
| 3,667,597 | A | 6/1972 | Hollister | |
| 3,700,138 | A | 10/1972 | Nelson | |
| 3,913,810 | A | 10/1975 | Shaw | |
| 4,574,952 | A | 3/1986 | Masui | |
| 5,029,787 | A | 7/1991 | Florentin | |
| 5,135,134 | A | 8/1992 | Dancy | |
| 5,213,243 | A | 5/1993 | Landon | |
| 5,259,550 | A | 11/1993 | Kuchenbecker | |
| 5,332,138 | A | 7/1994 | Gross et al. | |
| 5,368,188 | A | 11/1994 | Twardowski | |
| 5,398,856 | A | 3/1995 | Shyu | |
| 5,609,269 | A | 3/1997 | Behnke et al. | |
| D420,236 | S | 2/2000 | Parkes et al. | |
| 6,170,725 | B1 | 1/2001 | Ganues | |
| 6,279,775 | B1 | 8/2001 | Parkes et al. | |
| 6,318,590 | B1 | 11/2001 | McMurray-Stivers | |
| 6,364,185 | B2 | 4/2002 | Wu | |
| 6,530,473 | B1 | 3/2003 | St. Felix | |
| 2002/0000444 | A1 * | 1/2002 | Bliss | 220/628 |
| 2003/0178336 | A1 * | 9/2003 | Zomorodi et al. | 206/494 |
| 2003/0218013 | A1 | 11/2003 | Altman | |

FOREIGN PATENT DOCUMENTS

| | | | |
|---|---|---|---|
| EP | 0818 400 | A1 | 1/1998 |
| WO | WO 99/29602 | A1 | 6/1999 |
| WO | WO 01/70081 | A2 | 9/2001 |
| WO | WO 01/70582 | A2 | 9/2001 |

* cited by examiner

*Primary Examiner*—Gene O. Crawford
*Assistant Examiner*—Timothy Waggoner
(74) *Attorney, Agent, or Firm*—Scott A. Baum

(57) ABSTRACT

Different embodiments for adapting a package, such as a tissue carton or wet wipes container, for placement into a cup holder or for being secured by a cup holder are disclosed. By adapting existing packages containing disposable articles to fit into a cup holder, the package can be kept securely in place in an automobile. By adapting the existing package design, existing packaging machinery can be used to produce the product.

20 Claims, 10 Drawing Sheets

DISPENSER FOR DISPENSING TWO DIFFERENT SUBSTRATES

BACKGROUND

Facial tissue housed in a dispensing carton is often placed into an automobile for use while traveling. However, it is often difficult to affix the tissue carton to the automobile in a manner that prevents the container from moving about the interior space of the vehicle. Often times the carton ends up on the floor of the vehicle where it is stepped upon or it can slide underneath the seat preventing access while driving. Additionally, if placed on the seat, the carton could be sat on. Frequently, the carton and tissue inside is damaged spilling its contents or the tissue becomes dirty. Usually the carton and the partially dispensed tissue is thrown out long before all the tissue inside is used up.

Previous solutions to this problem have proven unsatisfactory. For example, adhesives on the carton or holders that attach to the vehicle into which the carton is placed have been tried. Adhesives having sufficient strength to hold the carton or the holder can mar or damage the surface to which it is applied. Furthermore, the extreme temperatures of the car's interior, if left in the direct sun or outside when below freezing, often proves challenging for keeping a removable adhesive functional.

Round or cylindrical containers having a circular sidewall that fit into a cup holder have been tried. However, these packaging formats may not be adaptable to high speed packing operations, such as the multi-folders and cartoners, used by many facial tissue manufacturers. The maximum number of tissues that such containers can hold is typically less than the flat or upright tissue carton that is frequently used to dispense facial tissue. Lastly, the containers can suffer from dispensing problems due to their size and the geometry of the dispensing opening.

Hence there is a need for a tissue dispenser that is capable of being securely affixed to the interior of an automobile in a manner that does not require modification or addition to the vehicle's interior or subject the interior to marring or other damage. Furthermore, there is a need for such a dispenser to be compatible with existing high speed packing operations for cost effective efficient production. There is also a need for a tissue dispenser that can be used either in the home or the car, or be readily moved between the car and the home.

SUMMARY

The inventors have found that the above problems can be overcome by adapting existing packages containing disposable articles, such as facial tissue cartons or wet wipes containers, to fit into a cup holder. By adapting the package to fit in a cup holder, it can be kept securely in place in an automobile. By adapting the package design to fit into a cup holder, existing packaging machinery can be used to produce the package.

Hence, in one embodiment, the invention resides in a product comprising: a package containing at least one disposable article; the package comprising a top, a bottom, and a non-circular sidewall; and the package comprising a fifth panel for attaching the package to a cup holder.

In another embodiment, the invention resides in a product comprising: a package containing at least one disposable article; the package comprising a top, a bottom, and a non-circular sidewall; a dispensing opening located in the top; and an adaptor aperture located in the bottom.

BRIEF DESCRIPTION OF THE DRAWINGS

The above aspects and other features, aspects, and advantages of the present invention will become better understood with regard to the following description, appended claims, and accompanying drawings in which:

Figure 1:
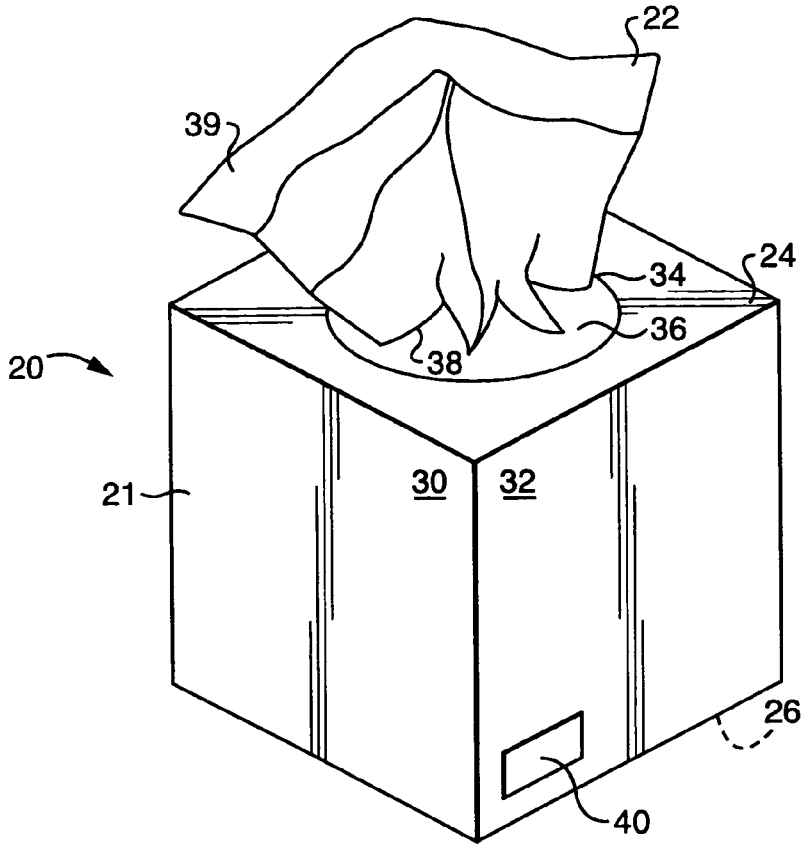
FIG. 1 illustrates one embodiment of a tissue carton.

Repeated use of reference characters in the specification and drawings is intended to represent the same or analogous features or elements of the invention.

DEFINITIONS

As used herein, forms of the words "comprise", "have", and "include" are legally equivalent and open-ended. Therefore, additional non-recited elements, functions, steps or limitations may be present in addition to the recited elements, functions, steps, or limitations.

As used herein, "cup holder" is a device designed to support and hold standard beverage containers such as aluminum soda cans, plastic soda bottles, or various reusable travel cups. Cup holders are often present in automobiles, trucks, tractors, and other motorized vehicles. Cup holders are also often present in lawn furniture such as chairs, tables, and swings.

As used herein, "disposable article" means an item intended for a single use after which it is thrown away. Examples of disposable articles include, but are not limited to, paper products such as facial tissue, bath tissue, and paper towels; infant products such as diapers, nappies, and wet wipes; child products such as training pants, swimwear, and bedwetting products; feminine products such as sanitary napkins, liners, and tampons; adult incontinent products such as undergarments, briefs, guards for men, and liners; cleaning products such as wipes and makeup removal pads; and health care products such as masks, gloves, gowns, and drapes.

DETAILED DESCRIPTION

It is to be understood by one of ordinary skill in the art that the present discussion is a description of exemplary embodiments only, and is not intended as limiting the broader aspects of the present invention, which broader aspects are embodied in the exemplary construction.

Referring now to FIGS. 1, 2, 3, and 4, one embodiment of the invention is illustrated. A package 20 having an exterior 21 and enclosing an interior is shown. Disposed within the package's interior is a disposable article 22. In this embodiment, the package comprises an upright facial tissue carton and the disposable article comprises a plurality of facial tissues. In an upright tissue carton, the facial tissues are formed into an inverted, U-shaped stack before being placed into the carton. In an alternative embodiment, the package could be a flat facial tissue carton where the stack of tissues is not bent or folded within the carton's interior. The package includes a top 24, a bottom 26, and a sidewall 28. In the illustrated embodiment, the sidewall comprises four generally rectangular panels, such as panels 30 and 32, that intersect at approximately 90 degree angles. Located in the top is a dispensing opening 34. In one embodiment, the bottom was approximately 11 cm by 11 cm and the height of the sidewall was approximately 12.8 cm.

The dispensing opening 34 can comprise a simple cutout through the package's exterior enabling access to the package's interior. In other embodiments, the dispensing opening can include additional elements such as a dispensing film 36 having an aperture 38. The aperture can be in the form of a slit, oval, X-shaped cut, or other geometry as desired. In another embodiment, the dispensing opening can include a removable cover or surf board that is removed for dispensing to access the facial tissue. Alternatively, a film wrap can be placed over the dispensing opening to keep the tissue clean until the film is removed for dispensing.

The facial tissues 39 are dispensed through the dispensing opening and can be prevented from falling back into the carton's interior by the aperture within the film. The package can also have a brand indicator 40 that can be placed on any portion of the exterior. The brand indicator can either identify the manufacturer of the product or represent a trademark linked to the manufacturer of the product.

Figure 2:
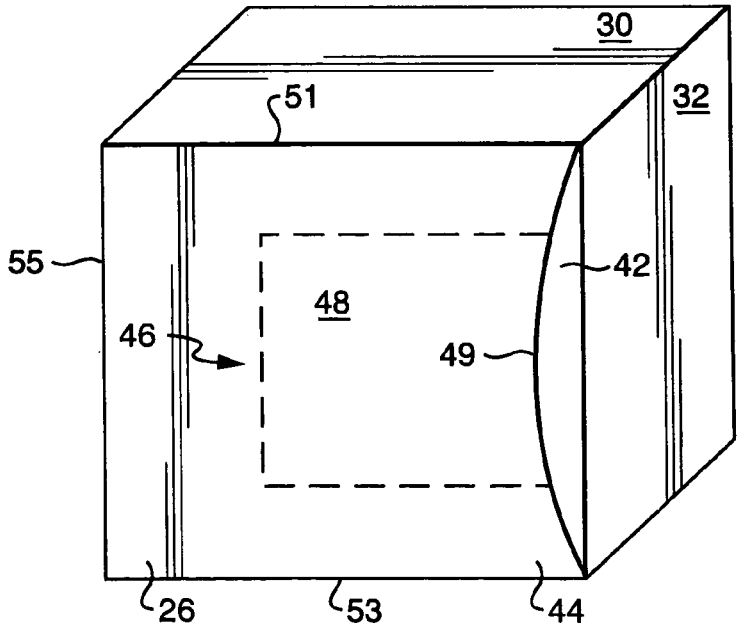
FIG. 2 illustrates the bottom view of the carton of FIG. 1.

Referring now to FIG. 2, the bottom of the carton of FIG. 1 is illustrated in more detail. The bottom is comprised of a bottom panel 42, and a fifth panel 44 attached to the carton's bottom. In FIG. 2, the bow of the fifth panel away from the bottom panel is exaggerated for clarity. The fifth panel can be used to hold an adaptor member 50 (FIGS. 3 and 4), which enables the carton to be placed into a cup holder. When not in use to hold the carton in an automobile cup holder, the fifth panel would lie flat against the bottom panel. Located in the fifth panel is a slot 46, which can be already cutout (not illustrated), or which can be formed by removing a perforated panel 48 from the fifth panel. To facilitate removal of the perforated panel, an arcuate finger cutout on an unattached edge 49 can be present. Alternatively, the unattached edge can have a tab, handle, or other extension to facilitate removing the perforated panel.

In one embodiment, the bottom panel 42 has a maximum dimension greater than the maximum dimension of the cup holder such that the carton does not fit directly into the cup holder. Instead, an adaptor member is used in conjunction with the carton to enable the carton to be positioned in the cup holder. In various embodiments, the maximum dimension of the bottom panel can be about 80 mm or greater, about 90 mm or greater, or about 100 mm or greater. By using a carton having a larger bottom panel, the resulting interior volume of the carton is greater enabling the carton to house and dispense more facial tissues than round containers that fit directly into the cup holder. Furthermore, by keeping the standard size of the carton, the same machinery used to fill standard upright tissue cartons can be used to fill upright tissue cartons having a fifth panel.

Figure 3:
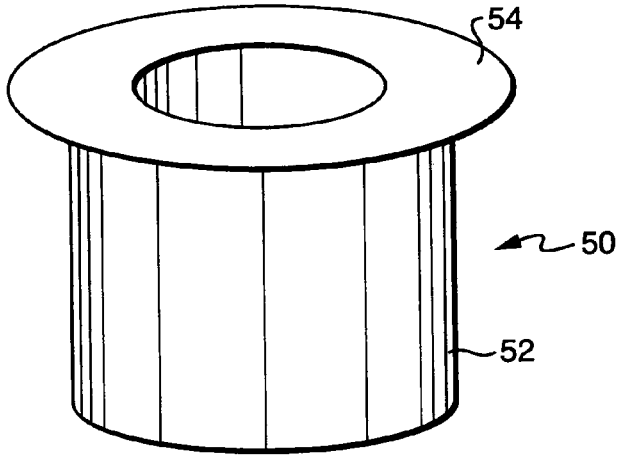
FIG. 3 illustrates one embodiment of the adaptor member.
Figure 4:
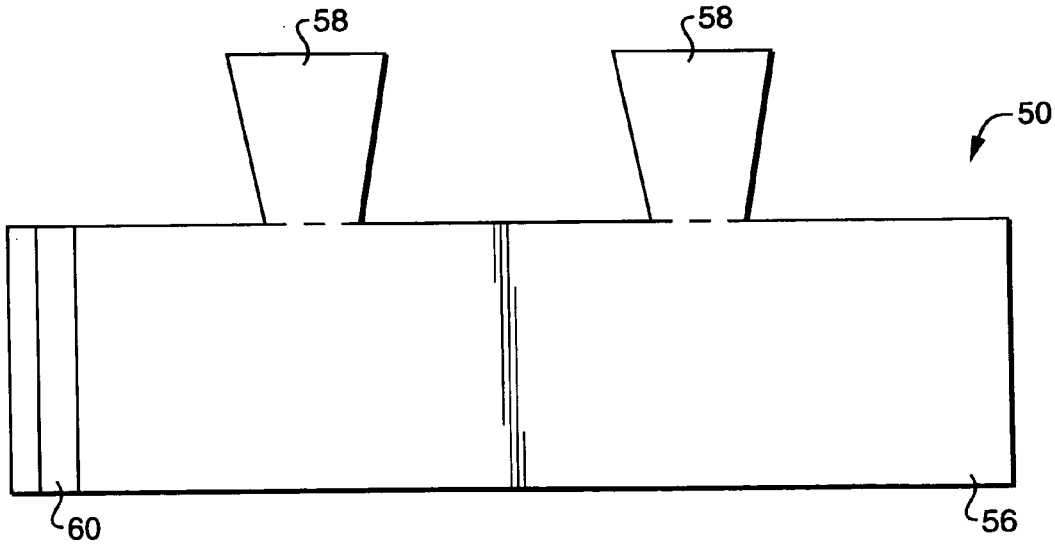
FIG. 4 illustrates another embodiment of the adaptor member.

The length of the slot perpendicular to the unattached edge and the width of the slot along the unattached edge can be adjusted as needed to accept the adaptor member 50 (FIGS. 3 and 4). In various embodiments, the length of the slot is such that it is approximately equal to one-half the length of the carton plus the radius of the adaptor member's circular body 52. In this manner, the center of the circular body 52 is aligned with the center of the tissue container.

For example, for a facial tissue carton, the length of the slot may range from about 10 mm to about 220 mm, such as from about 50 mm to about 100 mm. While in one case it may be advantageous to have the center of the circular body 52 centered with respect to the bottom panel 42, there are times when an offset may be preferred and this offset can be controlled by the length of the slot. In general, the slot will have a length exceeding the diameter of the circular body 52. In various embodiments, the minimum slot length can be about 40 mm or greater, or about 50 mm or greater.

The width of the slot should be less than the diameter of the circular flange 54. In one embodiment, the width of the slot is slightly greater than the diameter of the uppermost part of the circular body 52 directly adjacent the circular flange 54. In various embodiments, the width of the slot can be from about 30 mm to about 90 mm, such as from about 40 mm to about 80 mm.

The fifth panel 44 can be a separate panel attached to the bottom panel, the sidewall, or other portions of the carton. Alternatively, the fifth panel can be integrally connected to at least one other carton panel when the carton is die cut from a carton blank such that after folding and assembling the carton, the fifth panel resides on the bottom as shown. In various embodiments, the fifth panel can be attached to the bottom panel or other portion of the carton along at least two edges (one of which can be an integral connection to another carton panel). The two edges can be opposing edges such as a top edge 51 and a bottom edge 53. Alternatively, the fifth panel can be attached along the top edge, the bottom edge and a left edge 55 on three sides leaving the right side the unattached edge where the slot starts.

Referring now to FIG. 3, one embodiment of an adaptor member 50 is shown. The purpose of the adaptor member is to enable the package to fit in a cup holder by adapting the size and shape of the package's bottom to fit into the cup holder regardless of the original size or shape of the package. The adaptor member enables the placement of the square tissue carton into the round cup holder. Thus, packages having non-circular sidewalls can be adapted to fit into the round cup holder. The adaptor member can be constructed from a variety of suitable materials such as cardboard, corrugated materials, wood, plastic, metal, or other suitable materials such as composites.

The adaptor member, or at least the portion intended to be inserted into the cup holder, should have a maximum dimension approximately less than or equal to the diameter of a cup holder. In some embodiments, it may be desirable to have a light "press fit" or interference between the cup holder and the adaptor member to better secure the adaptor member in the cup holder. In one embodiment, the portion of the adaptor member fitting into the cup holder comprises a circular body having a circular shape. The outside diameter of the circular body is less than the diameter of the cup holder, such as less than about 80 mm. In a specific embodiment, the maximum outside dimension of the portion of the adaptor member inserted into the cup holder is equal to the diameter of a standard 12 oz. beverage container or approximately 68 mm.

While a circular shape is used in some embodiments for the portion of the adaptor member inserted into the cup holder, it should also be recognized that a wide variety of suitable shapes are possible for the portion of the adaptor member that fits into the cup holder. In this regard, the maximum outside dimension going in any direction across the bottom plane of the portion of the adaptor member that fits into the cup holder should be approximately equal to or less than the diameter of the cup holder. For example, if the body of the adaptor member is a square or rectangular in shape, then the length of the longest diagonal across the bottom of the adaptor member should be approximately equal to or less than the diameter of the cup holder.

The adaptor member in the embodiment illustrated in FIG. 3 resembles an upside down top hat having a circular body 52 and a circular flange 54. In order to place the square tissue carton of FIGS. 1 and 2 into a round cup holder, the adaptor member's circular flange is inserted between the fifth panel and the bottom panel with the circular body aligned with the slot. The adaptor member is then slid into the slot such that the adaptor member's circular flange is captured by the fifth panel and held in position. Once inserted, the adaptor member serves to position the tissue carton in the cup holder allowing for the tissue carton to be conveniently carried and positioned within an automobile's interior if desired. Upon removal of the adaptor member, the carton can be used just like an ordinary facial tissue carton. Furthermore, since the size or shape of the tissue carton is not altered, existing converting and packaging equipment can be used to produce the facial tissue carton.

The height of the adaptor member can be adjusted as needed to position the tissue carton in an automobile cup holder or other cup holder. Some applications may require a longer circular body section to prevent the bottom of the tissue carton from interfering with or hitting other portions of the car's interior. In various embodiments, the length of the circular body or adaptor member can be about 20 mm or greater, about 30 mm or greater, or about 40 mm or greater, between about 10 mm to about 100 mm, or between about 20 mm to about 60 mm. The maximum diameter of the circular flange can be adjusted as needed to adequately capture the circular flange between the fifth panel and the bottom panel.

Referring to FIG. 4, another embodiment for the adaptor member 50 is shown. In this embodiment, the adaptor member is shown unassembled. A flat blank 56 is cut in the shape of a rectangle with two projecting integrally connected tabs 58. If desired, the blank could be wrapped or attached to the facial tissue carton for removal and assembly by the purchaser.

The flat blank can be shaped into a circular body section and the tabs can be bent outwards to form upper flanges. To hold the flat blank in a circular shape, a fastening element 60 is located on at least one end. The fastening element can be any means known in the art for joining or holding two objects together such as tapes, adhesives, tabs and slots, buttons and button holes, rivets, pins, hook and loop materials, screws, or other mechanical fasteners, including combinations of such methods. In this instance, an adhesive was used. If desired, a removable peel strip can cover the adhesive prior to use. To use the adaptor member, it is formed into a circular shape and the opposing ends are held together by the adhesive. The tabs are bent outwards to form flanges, and then the flanges are inserted between the fifth panel and the bottom panel.

The length and height of the flat blank can be adjusted as needed such that when assembled, the adaptor member fits into a cup holder and positions the carton as required. Similarly, the design, shape, size, and number of tabs can be changed for connecting the adaptor member to the carton.

In an alternative embodiment, the fifth panel can be eliminated from the carton, and the adaptor member of either FIG. 3 or 4 simply attached to the bottom panel. For example, an adhesive can be applied to the circular flange or tabs, which can then be attached to the bottom panel. Alternatively, hook and loop material could be used.

The size and shape of the adaptor member can be changed from those illustrated in FIGS. 3 and 4. For example, the adaptor member can have another shape such as hexagonal, square, triangular, X-shaped, or oval to name a few, as long as the maximum dimension permits the adaptor member to be inserted into a cup holder. The adaptor member can be attached to the carton in various ways besides using a fifth panel. For example, the circular flange could be eliminated and replaced with a plurality of tabs that fit into slots in the carton's bottom. Any of the recited fastening elements could be used to attach the adaptor member to the carton.

Other modifications or designs of the adaptor member for holding the carton are possible. For example, the adaptor member could comprise a circular body and an upper rectangular or square tray having a sidewall. Thus, the adaptor member could be inserted into the cup holder and then the carton inserted into the tray.

Figure 5:
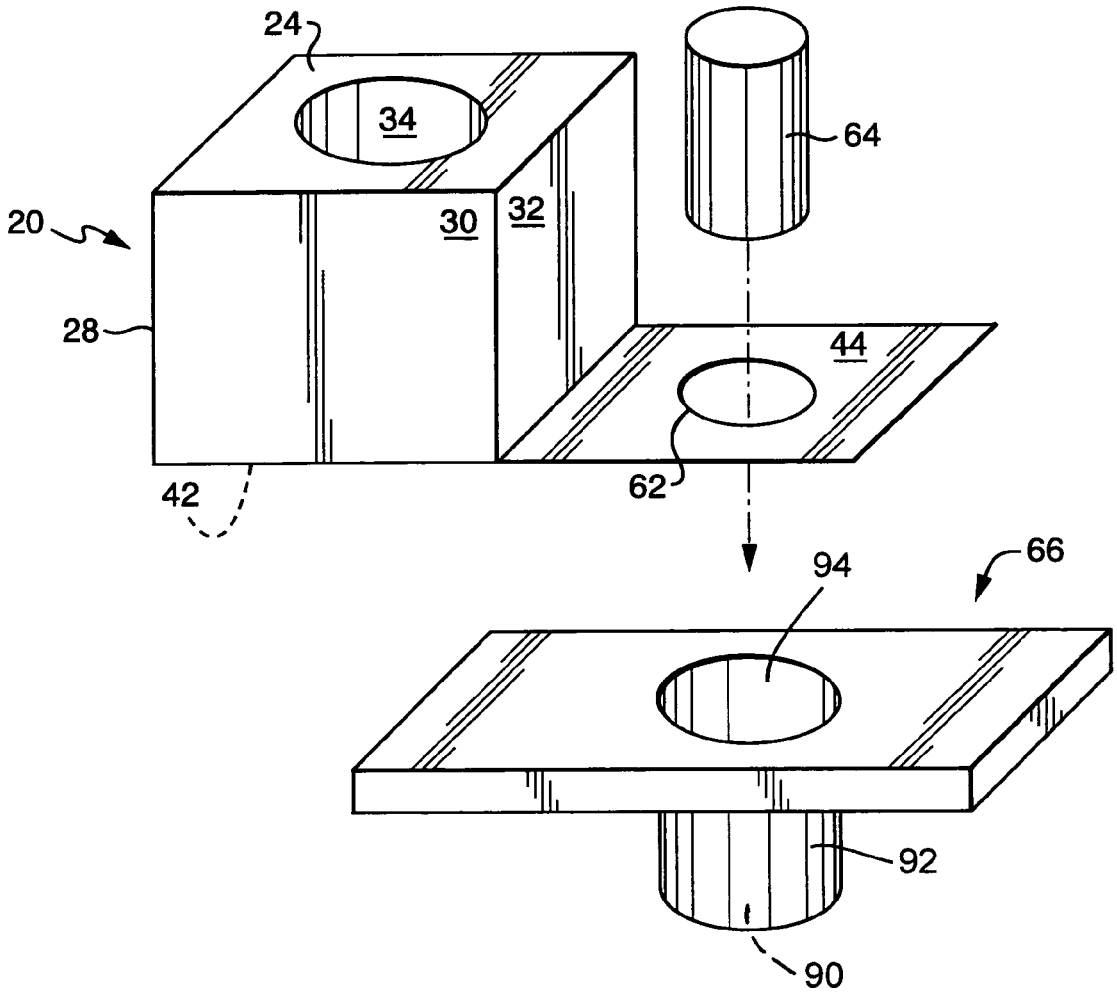
FIG. 5 illustrates another embodiment of a tissue carton.

Referring now to FIG. 5, another embodiment of the package is shown. In the illustrated embodiment, the fifth panel is integrally connected to the carton along one edge. This allows the fifth panel to be rotated away from the bottom panel, where it may be held in position by a fastening element, into a position extending from the sidewall as illustrated. The fifth panel contains an adaptor aperture 62. The adaptor aperture is utilized with a beverage container 64 (such as a soda can or bottle) or with the adaptor member 50 to secure the carton to a cup holder 66 including a bottom 90 for supporting the beverage container and a side support 92 for contacting the sidewall of the beverage container. The bottom 90 and side support 92 form a circular depression 94 for holding the beverage container. When using the carton in this manner, the fifth panel is rotated away from the bottom panel, positioned over the cup holder, and then the beverage container is inserted through the adaptor aperture securing the tissue carton.

The adaptor aperture 62 can be any size or shape needed to hold either the beverage container or the adaptor member in position. The adaptor aperture may contain a plurality of fingers or tabs for improved holding power such as those shown in FIG. 8. The adaptor aperture may be formed by a series of perforated lines such as those shown in FIG. 7. In another embodiment, the adaptor aperture can be formed in an elastic material or comprise elastic portions such that the material is stretched to conform around the beverage container or adaptor member. In another embodiment, the adaptor aperture can be formed by removing a punch-out or perforated portion of the fifth panel as shown in FIG. 6.

While shown attached along the bottom edge of the carton, the fifth panel could be attached to any portion of the package or along any of the carton's edges including along the top panel or along any of the sidewall panels. This would allow for rotation of the carton and the dispensing opening's location. Alternatively, instead of the adaptor aperture, the fifth panel could have straps, loops, or other fastening elements for securing the beverage container to the fifth panel when the fifth panel is located along a vertical edge.

Figure 6:
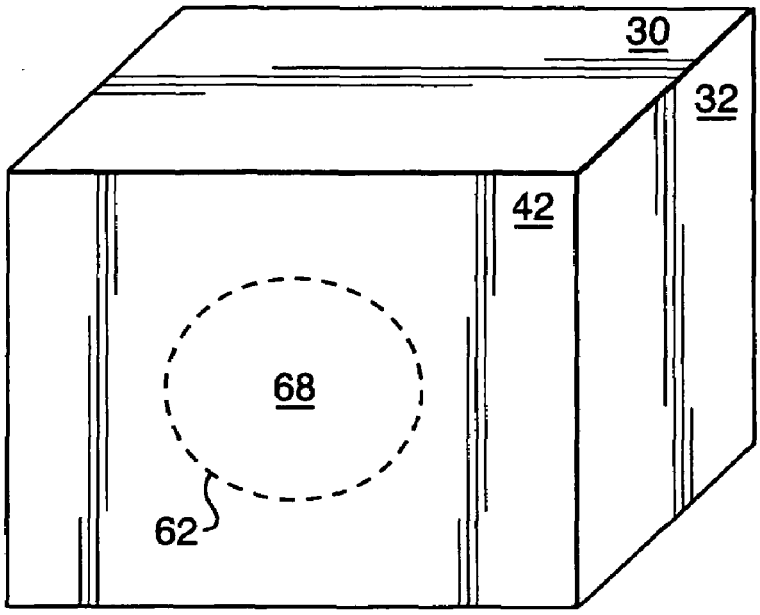
FIG. 6 illustrates another embodiment of a tissue carton.
Figure 9:
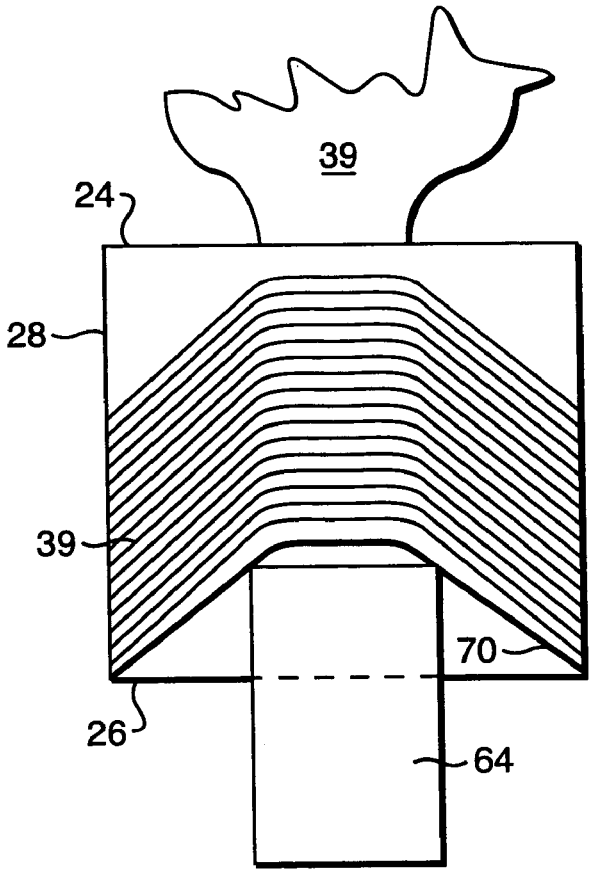
FIG. 9 illustrates another embodiment for the tissue carton of FIG. 6.

Referring now to FIGS. 6 and 9, another embodiment of the invention is illustrated. In this embodiment, the carton's bottom contains the adaptor aperture 62. If desired, the adaptor aperture can be created in the carton's bottom by removing a perforated adaptor cover 68. After removal, the beverage container or the adaptor member can be inserted into the adaptor aperture, and then the carton with the beverage container can be inserted into the cup holder.

If desired, a barrier layer 70 can be inserted inside of the carton between the facial tissues 39 and the bottom panel 42. The barrier layer can be a plastic film, paper, cardboard, non-woven, or other material that is either flexible or rigid. The barrier layer serves to protect the facial tissues from dirt and moisture, and can assist with dispensing by forcing the facial tissues toward the dispensing opening. The barrier layer can comprise a size smaller than the bottom panel such that it lays flat against the bottom panel or the barrier layer can comprise at least one dimension larger than the size of the bottom panel such that the barrier layer resiliently biases the facial tissues toward the dispensing opening as shown.

One advantage of the embodiment of FIG. 9 is that the beverage container acts not only to position the carton in the cup holder, but also serves as a clip lift device to prevent tissue fall back. As the stack of facial tissues is depleted, the beverage container pushes them and/or the barrier layer towards the dispensing opening assisting with dispensing.

Figure 7:
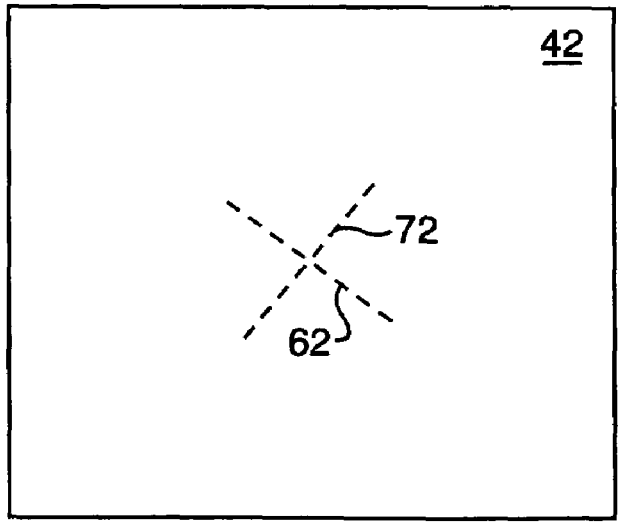
FIG. 7 illustrates another embodiment for the bottom of a tissue carton.
Figure 8:
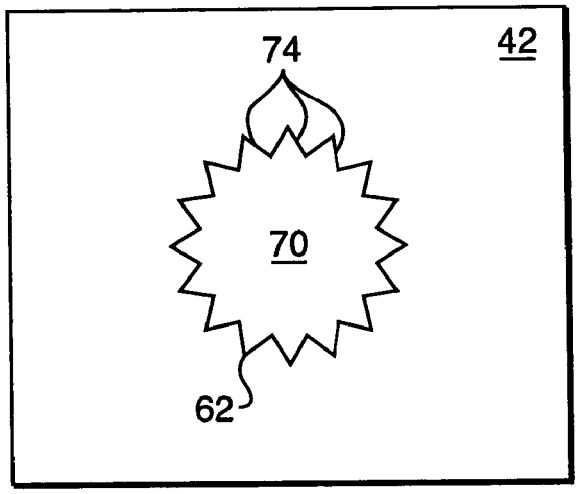
FIG. 8 illustrates another embodiment for the bottom of a tissue carton.

Referring now to FIGS. 7 and 8, alternative embodiments for the bottom panel are illustrated. Instead of cutting an aperture into the bottom panel, the bottom panel can contain an X-shaped perforated line 72 or other shaped perforated line or region that can be popped open to form the adaptor aperture. Alternatively, the adaptor aperture can have a plurality of tabs or fingers 74 that project into the adaptor aperture and help to securely hold the carton to the beverage container.

Any size or shaped adaptor aperture can be used. For example, the size may be appropriate for securing a standard 12 oz. aluminum soda can having a diameter of about 68 mm. In another embodiment, the size may be appropriate for inserting or screwing the threaded neck of a plastic screw top soda bottle into the adaptor aperture. For example, a soda bottle could be screwed into the adaptor aperture to secure the carton to the beverage container and then the bottle placed into a cup holder.

In one embodiment, a standard 16 oz. drink container comprises an upper portion that is necked down and threaded to accept a threaded cap. The threaded portion may have a base diameter of approximately 23 mm while the threads extending outwards may have an outside diameter of about 25 mm. For such a beverage container, the diameter of the adaptor aperture can be about 23 to about 24 mm. The neck of the bottle could then be threaded onto the aperture adaptor of the carton.

The perforated lines formed into the bottom panel (FIG. 7) could be concentric circles allowing for a choice of aperture size depending on the desired beverage container. In various embodiments of the invention, the adaptor aperture can be about 15 mm or greater, about 80 mm or less, or between about 20 mm to about 70 mm.

In another embodiment, the bottom panel or the fifth panel may have additional perforated lines to form extensions of the panel for attachment to the beverage container. For example, the triangular flaps in FIG. 7, instead of being punched into the carton's interior, could be pulled out from the bottom panel and a fastening element could be used to secure the flaps to the beverage container. Alternatively, shaped tabs or straps can be perforated into the bottom panel that are punched out and then attached to the beverage container.

Figure 10:
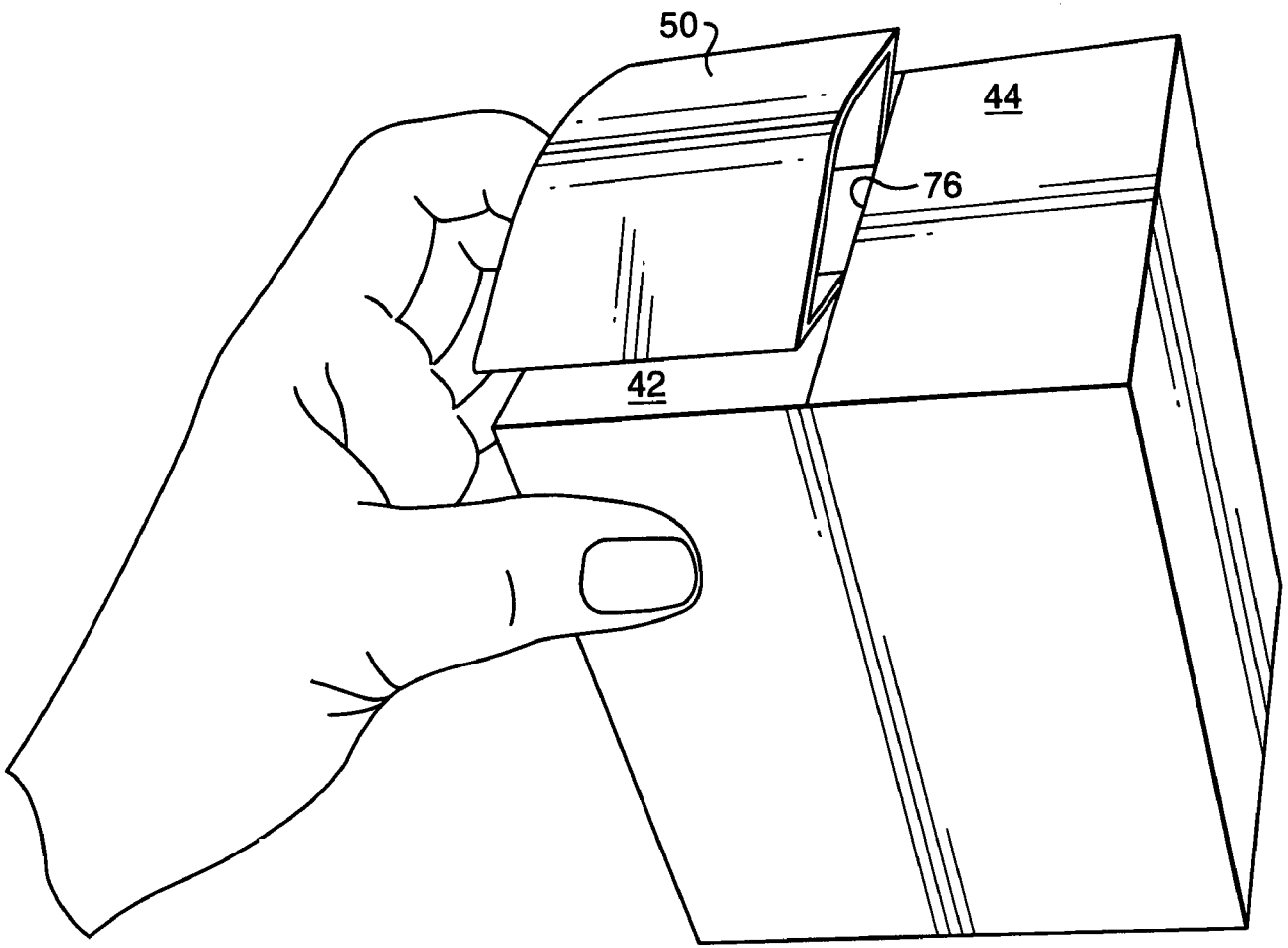
FIG. 10 illustrates another embodiment of a tissue carton.
Figure 11:
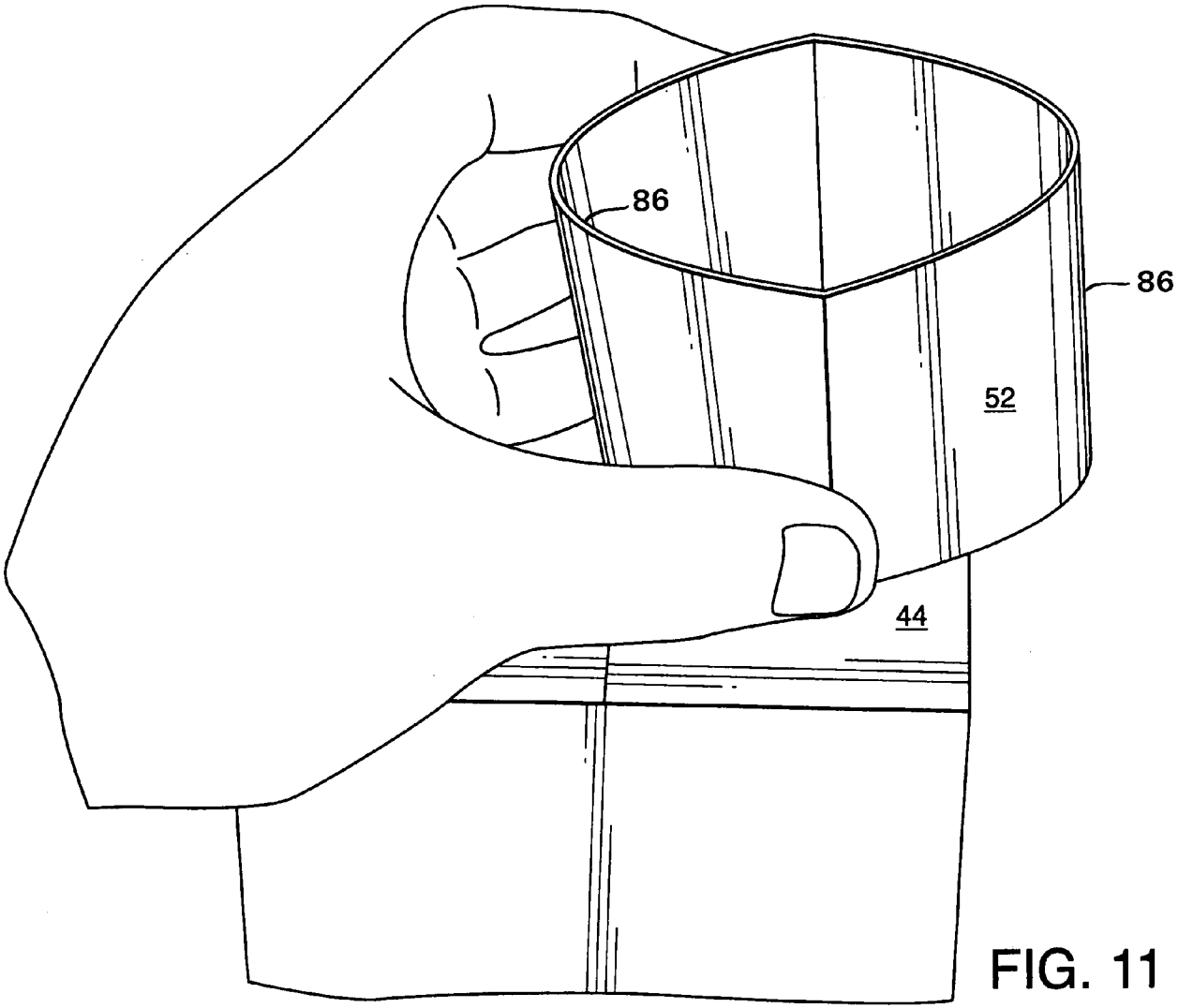
FIG. 11 illustrates another view of the embodiment of FIG. 10.

Referring now to FIGS. 10 and 11, another embodiment of the invention is illustrated. In this embodiment, the fifth panel 44 comprises an adaptor member 50 having a circular body 52. As illustrated, approximately one-half of the fifth panel is attached to the bottom panel 42. The remaining one-half of the fifth panel forms the adaptor member and is integrally connected by a living hinge 76 to the attached portion.

Initially the adaptor member, comprising two opposing adaptor sidewalls 86, is folded flat and rests against the bottom panel when not in use to hold the carton in a cup holder. Thus, when the carton is placed upright on a surface, the fifth panel and adaptor member are virtually undetectable. When the carton is to be placed into a cup holder, the adaptor member is rotated away from the bottom panel 42 and then formed into the circular body 52 as shown by applying pressure to the opposing adaptor sidewalls. To position the carton in a cup holder, the circular body is simply inserted, which holds the carton in position. If a resilient material is used to form the adaptor member, such that it tends to return to a closed position, or if a biasing element is included to close the adaptor member, then the edges where the opposing adaptor sidewalls meet will spring or bias themselves against the inside of the cup holder helping to secure the carton in the cup holder.

Depending on the design of the cup holder, a fastening element, such as at least one tab attached to the circular body and at least one slot in the fifth panel, can be used to secure the circular body in the opened position. Other fastening elements can be used to hold the circular body in the opened position against the fifth panel. The diameter of the circular body can be fixed as shown by assembling the opposing adaptor sidewalls in a predetermined fixed position, or the diameter can be adjustable, like a hat band, to fit various sized cup holders.

Figure 12:
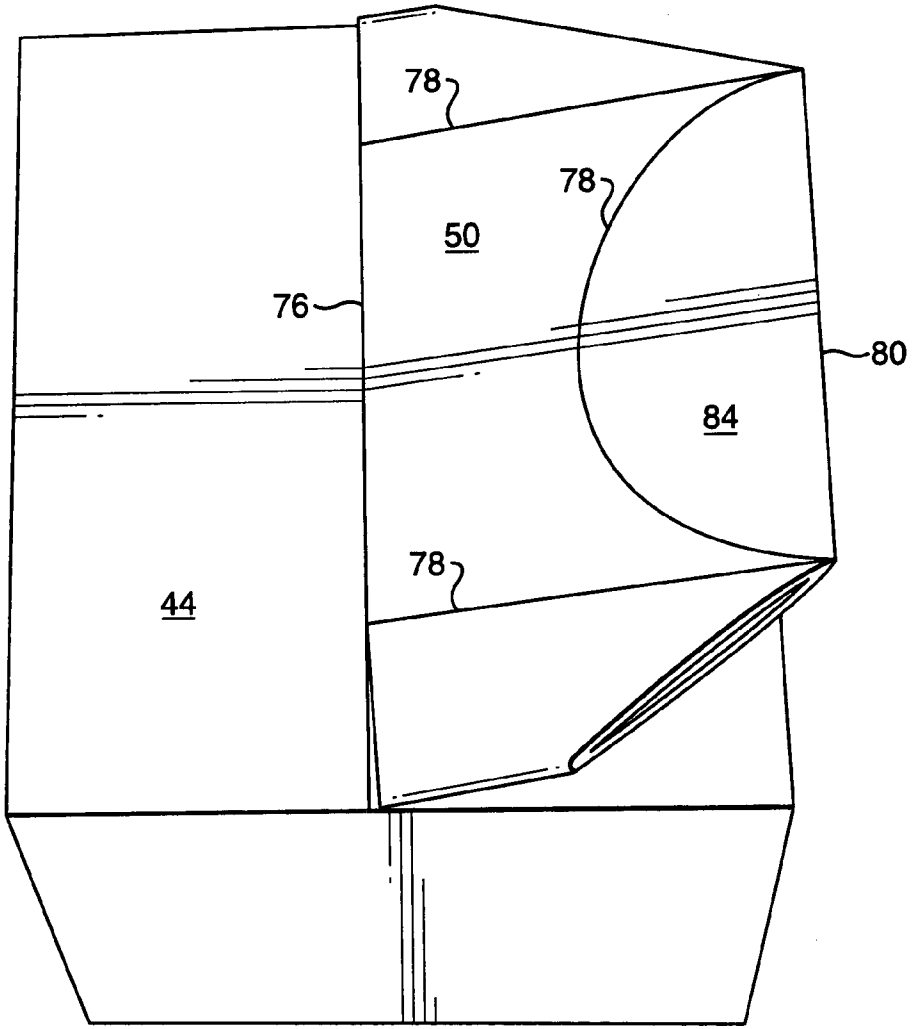
FIG. 12 illustrates another embodiment of a tissue carton.
Figure 13:
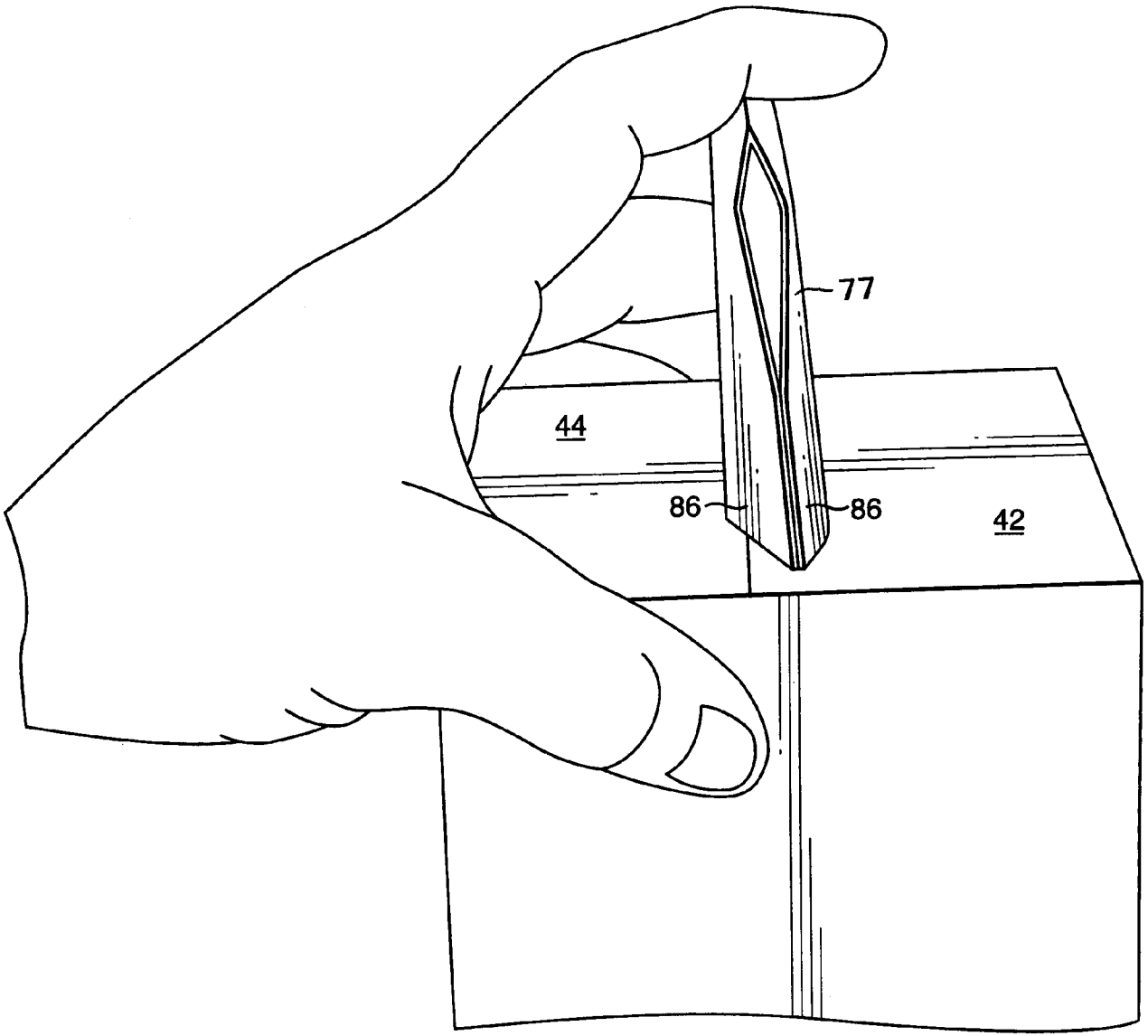
FIG. 13 illustrates another view of the embodiment of FIG. 12.
Figure 14:
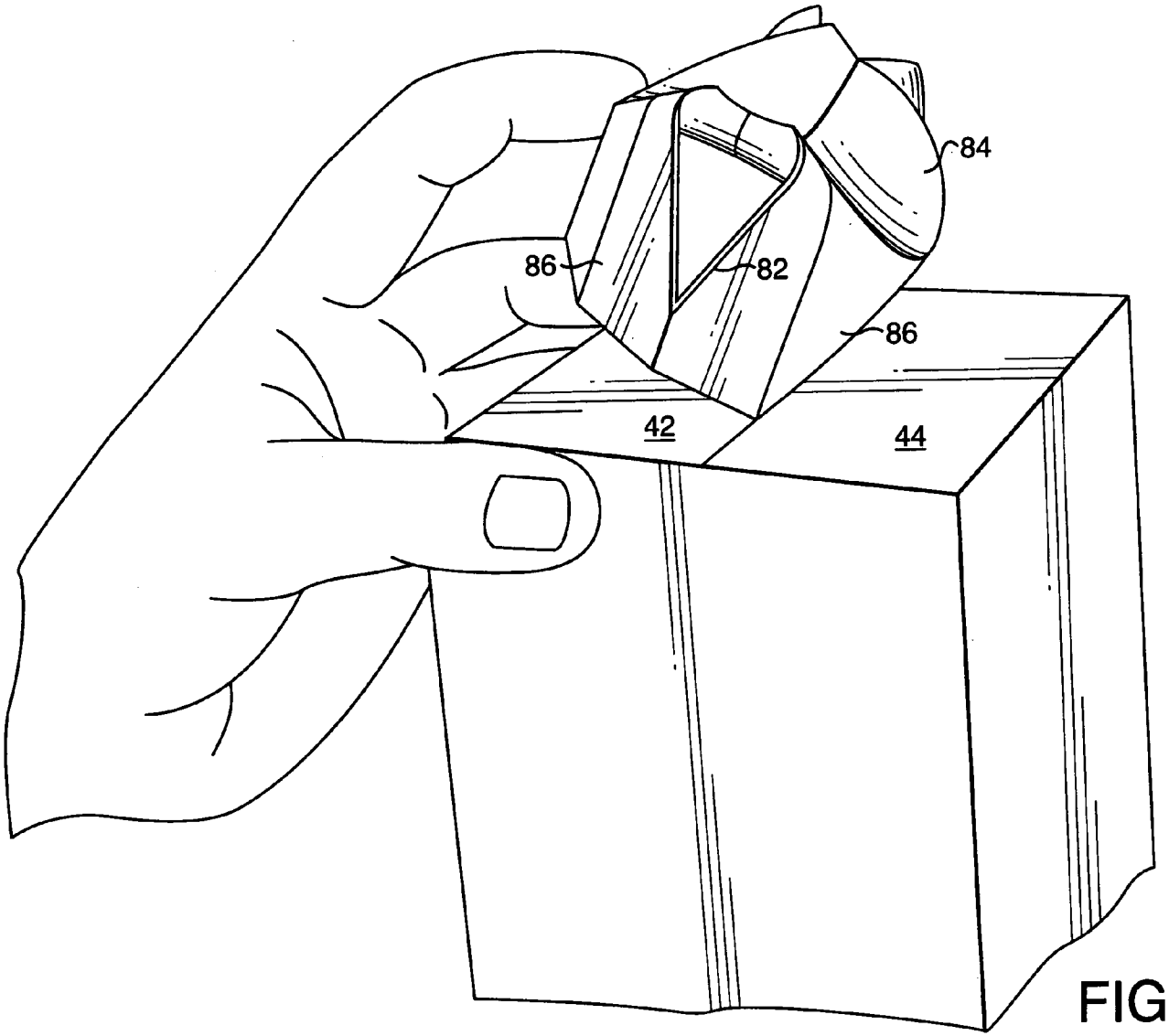
FIG. 14 illustrates another embodiment of the view of FIG. 13.

Referring now to FIGS. 12, 13 and 14, another embodiment of the invention is illustrated. As illustrated, approximately one-half of the fifth panel is attached to the bottom panel 42. The remaining one-half of the fifth panel forms the adaptor member 50 and is integrally connected by a living hinge 76 to the attached portion. Initially, the adaptor member is folded flat and rests against the bottom panel when not in use to hold the carton in a cup holder. Thus, when the carton is placed upright on a surface, the fifth panel and adaptor member are virtually undetectable.

In this embodiment, the adaptor member 50 comprises a V-shaped pocket 77 when folded flat against the bottom panel, and an adaptor member having a semi-circular or arcuate shape when opened. The adaptor member comprises a plurality of fold lines 78 (which may be scored if needed), a folded ridge 80 where a pair of opposing adaptor sidewalls 86 meet, a pair of opposing forming apertures 82, shaped like a heart, cut into the adaptor sidewalls disposed on either end of the folded ridge, and a concave bottom 84 shaped like a saddle.

To use the adaptor member to position the carton within a cup holder, the V-shaped pocket is rotated away from the bottom panel, and pressure is applied to the ridge. This forces the opposing adaptor sidewalls 86 outwards. By continuing to apply pressure to the ridge, the concave bottom is forced "over-center" and snaps into position. As a result, the adaptor member will stay in the opened position by the balance of forces acting on various parts of the adaptor member. To close the adaptor member, the concave bottom is pushed outwards, the opposing adaptor sidewalls compressed, and the adaptor member lowered into position against the bottom panel. A fastening element can be used to hold the adaptor member flat against the bottom panel if desired. Additionally, another or the same fastening element, such as at least one tab attached to the sidewall and at least one slot in the fifth panel, can be used to secure the circular body in the opened position. Other fastening elements can be used to hold the adaptor member in either the open or the closed position.

The fifth panels of FIGS. 10 and 12 can be separate panels that are attached to the carton or the fifth panels can be integrally connected to the carton blank that is folded and assembled to form the carton. The adaptor member's sidewall or the adaptor member can be necked down near the carton's bottom such that the rubber flaps found near the top of many cup holders will engage with the adaptor member.

Shown and described in the various embodiments discussed herein are several means for adapting a package having a top, a bottom, and a non-circular sidewall to either fit into or be secured by a cup holder. Such means can include either singularly or in combination, a fifth panel; a fifth panel comprising either a slot, an adaptor member, an adaptor aperture, or other fastening element; an adaptor member; an adaptor member comprising a circular body; or an adaptor aperture for use with an adaptor member or beverage container.

While the above invention has been described in relation to a tissue carton, many other packages containing disposable articles can be modified using the concepts and embodiments disclosed herein. For example, wet wipes are often stored in square or rectangular packages that do not fit into a cup holder. An adaptor member can be used in conjunction with these packages for positioning the wet wipes' package in a cup holder.

Other modifications and variations to the present invention may be practiced by those of ordinary skill in the art, without departing from the spirit and scope of the present invention, which is more particularly set forth in the appended claims. It is understood that aspects of the various embodiments may be interchanged in whole or part or combined with other aspects of the various embodiments. All cited references, patents, or patent applications in the above application for letters patent are herein incorporated by reference in a consistent manner. In the event of inconsistencies or contradictions between the incorporated references and this application, the information present in this application shall prevail. The preceding description, given by way of example in order to enable one of ordinary skill in the art to practice the claimed invention, is not to be construed as limiting the scope of the invention, which is defined by the claims and all equivalents thereto.

We claim:

1. A product comprising:

a package containing at least one disposable article;

the package comprising a top, a bottom, and a non-circular sidewall;

means for adapting the package to either fit into or be attached to a cup holder comprising a side support; and wherein the means for adapting comprises a fifth panel.

2. The product of claim 1 comprising an adaptor aperture located in the fifth panel.

3. The product of claim 2 comprising a beverage container inserted into the adaptor aperture.

4. The product of claim 1 wherein the fifth panel comprises a slot and an adaptor member is inserted into the slot.

5. The product of claim 4 wherein the adaptor member comprises a circular body and a circular flange.

6. The product of claim 4 wherein the adaptor member comprises a circular body and a pair of tabs.

7. The product of claim 1 wherein the fifth panel comprises an adaptor member.

8. The product of claim 7 wherein the adaptor member comprises a pair of opposing adaptor sidewalls, which can be formed into a circular body, and the adaptor member is connected to the fifth panel by a living hinge.

9. The product of claim 8 wherein the adaptor member comprises a V-shaped pocket, which can be opened into a circular shape, the adaptor member when opened having a saddle-shaped bottom, and the adaptor member is connected to the fifth panel by a living hinge.

10. The product of claim 1 wherein the fifth panel is attached to the bottom.

11. The product of claim 7 or 8 wherein the adaptor member comprises a circular body that has a diameter less than about 80 mm.

12. The product of claim 9 comprising a folded ridge where the pair of opposing adaptor sidewalls meet, and a pair of forming apertures disposed on either end of the folded ridge.

13. The product of claim 12 wherein the pair of forming apertures are heart shaped.

14. The product of claims 9 or 12 wherein the saddle-shaped bottom can be forced over-center to snap into an opened position.

15. The product of claims 1, 2, 4, 7, 8, or 9 wherein the package comprises a carton, the sidewall comprises four generally rectangular panels, a dispensing opening is located in the top, and the disposable article comprises a paper product.

16. A product comprising:

a package containing at least one disposable article;

the package comprising a top, a bottom, a non-circular sidewall, and a fifth panel comprising an adaptor member; and the adaptor member comprising a pair of opposing adaptor sidewalls which can be formed into a circular body, and the adaptor member is connected to the fifth panel by a living hinge.

17. The product of claim 16 wherein the adaptor member comprises a V-shaped pocket, which can be opened into the circular shape and the adaptor member when opened having a saddle-shaped bottom.

18. The product of claim 17 comprising a folded ridge where the pair of opposing adaptor sidewalls meet, and a pair of forming apertures disposed on either end of the folded ridge.

19. The product of claim 18 wherein the pair of forming apertures are heart shaped.

20. The product of claim 17 wherein the saddle-shaped bottom can be forced over-center to snap into an opened position.

* * * * *